US009041703B2

(12) United States Patent
Yen

(10) Patent No.: US 9,041,703 B2
(45) Date of Patent: May 26, 2015

(54) SOURCE DRIVER

(71) Applicant: Raydium Semiconductor Corporation, Hsinchu (TW)

(72) Inventor: Yu-Jen Yen, Tainan (TW)

(73) Assignee: Raydium Semiconductor Corporation, Hsinchu County (TW)

( * ) Notice: Subject to any disclaimer, the term of this patent is extended or adjusted under 35 U.S.C. 154(b) by 283 days.

(21) Appl. No.: 13/792,611

(22) Filed: Mar. 11, 2013

(65) Prior Publication Data

US 2013/0235007 A1 Sep. 12, 2013

(30) Foreign Application Priority Data

Mar. 9, 2012 (TW) ..... 101108055 A

(51) Int. Cl.
*G09G 5/00* (2006.01)
*G09G 3/36* (2006.01)

(52) U.S. Cl.
CPC ..... *G09G 3/36* (2013.01); *G09G 3/3614* (2013.01); *G09G 3/3685* (2013.01); *G09G 2310/0297* (2013.01)

(58) Field of Classification Search
CPC ..... G09G 2310/027; G09G 2310/0297; G09G 3/36; G09G 3/3614; G09G 3/3685; G09G 2310/0289; G09G 2310/0291; G09G 2310/0286; G09G 3/3266; H03F 3/303
See application file for complete search history.

(56) References Cited

U.S. PATENT DOCUMENTS

2007/0018922 A1* 1/2007 Lee et al. ..... 345/89
2007/0242024 A1* 10/2007 Sung ..... 345/100
2011/0273415 A1* 11/2011 Hsu ..... 345/211

* cited by examiner

*Primary Examiner* — Kent Chang
*Assistant Examiner* — Gerald Oliver

(57) ABSTRACT

A source driver applied in a liquid crystal display is disclosed. The source driver at least includes a first pair of channels, a second pair of channels, two P-type digital/analog converting modules, two N-type digital/analog converting modules, two multiplexers, two polarization multiplexers, and four amplifying and buffer modules. The first pair of channels includes a first channel and a second channel which are adjacent, and the second pair of channels includes a third channel and a four channel which are adjacent. The two P-type digital/analog converting modules correspond to a first set of gamma values, and the two N-type digital/analog converting modules correspond to a second set of gamma values. The first pair of channels shares the two P-type digital/analog converting modules and the second pair of channels shares the two N-type digital/analog converting modules to save the used chip area.

10 Claims, 5 Drawing Sheets

SOURCE DRIVER

BACKGROUND OF THE INVENTION

1. Field of the Invention

The invention relates to a liquid crystal display; in particular, to a source driver applied in the liquid crystal display having the design of two pairs of channels sharing four digital/analog converting modules to save the chip usage area.

2. Description of the Related Art

In recent years, with the development of display technology, various novel types of display apparatus having different functions and advantages are shown in the market. For a general liquid crystal display, the liquid crystal driving chip including a source driving chip and a date driving chip play very important roles.

Please refer to FIG. 1. FIG. 1 illustrates a structure schematic diagram of the conventional source driver. As shown in FIG. 1, in the conventional source driver SG, after the a digital data signal Dn is inputted to a first latch module LAT1 and a second latch module LAT2, the digital data signal Dn will be divided into $Dn_1$ and $Dn_2$ and $Dn_1$ and $Dn_2$ will be transmitted to a first level shifting module LS1 corresponding to a first channel CH1 and a second level shifting module LS2 corresponding to a second channel CH2 respectively. Wherein, the output terminal of the first level shifting module LS1 corresponding to a first channel CH1 is coupled to a first P-type digital/analog converting module PDAC1 and a second P-type digital/analog converting module PDAC2 respectively; the output terminal of the second level shifting module LS2 corresponding to a second channel CH2 is coupled to a first N-type digital/analog converting module NDAC1 and a second N-type digital/analog converting module NDAC2 respectively.

Next, a high-voltage multiplexer MUX1 corresponding to the first channel CH1 selectively outputs an analog data signal $An_{11}/An_{12}$ received from the first P-type digital/analog converting module PDAC1 and the second P-type digital/analog converting module PDAC2 to a polarization multiplexer POLMUX; a high-voltage multiplexer MUX2 corresponding to the second channel CH2 selectively outputs an analog data signal $An_{21}/An_{22}$ received from the first N-type digital/analog converting module NDAC1 and the second N-type digital/analog converting module NDAC2 to the polarization multiplexer POLMUX. Then, the polarization multiplexer POLMUX will selectively output the analog data signals $An_{11}/An_{12}$ and $An_{21}/An_{22}$ to the first channel CH1 or the second channel CH2 through a first amplifying and buffer module OPBU1 or a second amplifying and buffer module OPBU2.

From above, it can be known that for the conventional source driver SG having two sets of Gamma values, four digital/analog converting modules (for example, the first P-type digital/analog converting module PDAC1, the second P-type digital/analog converting module PDAC2, the first N-type digital/analog converting module NDAC1 and the second N-type digital/analog converting module NDAC2) should be correspondingly disposed for every two adjacent channels (for example, the first channel CH1 and the second channel CH2) to meet the practical operation requirements of the conventional source driver SG. However, this will also occupy more chip area, so that the volume of the chip cannot be further reduced.

SUMMARY OF THE INVENTION

Therefore, the invention provides a source driver applied to a liquid crystal display to solve the above-mentioned problems occurred in the prior arts.

A first embodiment of the invention is a source driver. In this embodiment, the source driver is applied to a liquid crystal display and has two sets of Gamma values. The source driver includes a first pair of channels, a second pair of channels, a first P-type digital/analog converting module, a second P-type digital/analog converting module, a first N-type digital/analog converting module, a second N-type digital/analog converting module, a first multiplexer, a second multiplexer, a first polarization multiplexer, a second polarization multiplexer, a first amplifying and buffer module, a second amplifying and buffer module, a third amplifying and buffer module, and a fourth amplifying and buffer module. Wherein, the first pair of channels includes a first channel and a second channel adjacent to the first channel; the second pair of channels includes a third channel and a fourth channel adjacent to the third channel. The first P-type digital/analog converting module is used for converting a first digital data signal into a first analog data signal; the second P-type digital/analog converting module is used for converting a second digital data signal into a second analog data signal; the first N-type digital/analog converting module is used for converting a third digital data signal into a third analog data signal; the second N-type digital/analog converting module is used for converting a fourth digital data signal into a fourth analog data signal.

The first multiplexer is coupled to the first P-type digital/analog converting module and the second P-type digital/analog converting module respectively, and it is used for receiving the first analog data signal and the second analog data signal from the first P-type digital/analog converting module and the second P-type digital/analog converting module respectively; the second multiplexer is coupled to the first N-type digital/analog converting module and the second N-type digital/analog converting module respectively, and it is used for receiving the third analog data signal and the fourth analog data signal from the first N-type digital/analog converting module and the second N-type digital/analog converting module respectively. The first polarization multiplexer is coupled to the first multiplexer and the second multiplexer, and it is used for receiving the first analog data signal or the second analog data signal from the first multiplexer and receiving the third analog data signal or the fourth analog data signal from the second multiplexer; the second polarization multiplexer is coupled to the first multiplexer and the second multiplexer, and it is used for receiving the first analog data signal or the second analog data signal from the first multiplexer and receiving the third analog data signal or the fourth analog data signal from the second multiplexer.

The first amplifying and buffer module is coupled between the first polarization multiplexer and the first channel of the first pair of channels and used for outputting the first analog data signal, the second analog data signal, the third analog data signal, or the fourth analog data signal to the first channel; the second amplifying and buffer module is coupled between the first polarization multiplexer and the second channel of the first pair of channels and used for outputting the first analog data signal, the second analog data signal, the third analog data signal, or the fourth analog data signal to the second channel; the third amplifying and buffer module is coupled between the second polarization multiplexer and the third channel of the second pair of channels and used for outputting the first analog data signal, the second analog data signal, the third analog data signal, or the fourth analog data signal to the third channel; the fourth amplifying and buffer module is coupled between the second polarization multiplexer and the fourth channel of the second pair of channels and used for outputting the first analog data signal, the second analog data signal, the third analog data signal, or the fourth analog data signal to the fourth channel.

In practical applications, the source driver can further include two first latch modules, a low-voltage multiplexer, and two second latch modules. The low-voltage multiplexer is coupled between the two first latch modules and the two second latch modules.

In an embodiment, the source driver can further include a first level shifting module, a second level shifting module, a third level shifting module, and a fourth level shifting module. The first level shifting module, the second level shifting module, the third level shifting module, and the fourth level shifting module are coupled to the first P-type digital/analog converting module, the second P-type digital/analog converting module, the first N-type digital/analog converting module, and the second N-type digital/analog converting module respectively. The first level shifting module and the fourth level shifting module are coupled to one of the two second latch modules, and the second level shifting module and the third level shifting module are coupled to the other of the two second latch modules.

In another embodiment, the source driver further includes a first level shifting module and a second level shifting module. The first level shifting module is coupled to the first P-type digital/analog converting module and the second N-type digital/analog converting module respectively, and the second level shifting module is coupled to the second P-type digital/analog converting module and the first N-type digital/analog converting module respectively.

Compared to the prior art, the source driver having two sets of Gamma values according to the invention only needs four digital/analog converting modules correspondingly disposed for its two pairs of channels; that is to say, the four digital/analog converting modules can be shared by the two pairs of channels. Therefore, the number of the digital/analog converting modules the source driver of the invention needs can be reduced to the half of the prior arts, and the chip usage area can be largely saved to further reduce the volume of the chip.

The advantage and spirit of the invention may be understood by the following detailed descriptions together with the appended drawings.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
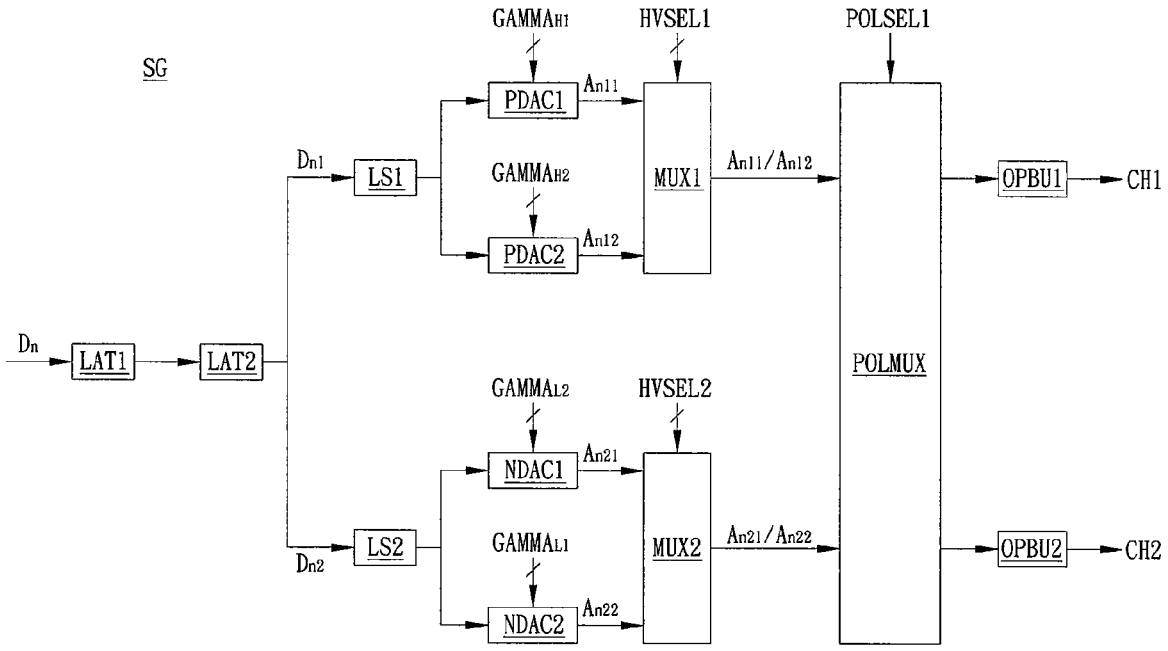
FIG. 1 (PRIOR ART)
FIG. 1 illustrates a structure schematic diagram of the conventional source driver.
Figure 2:
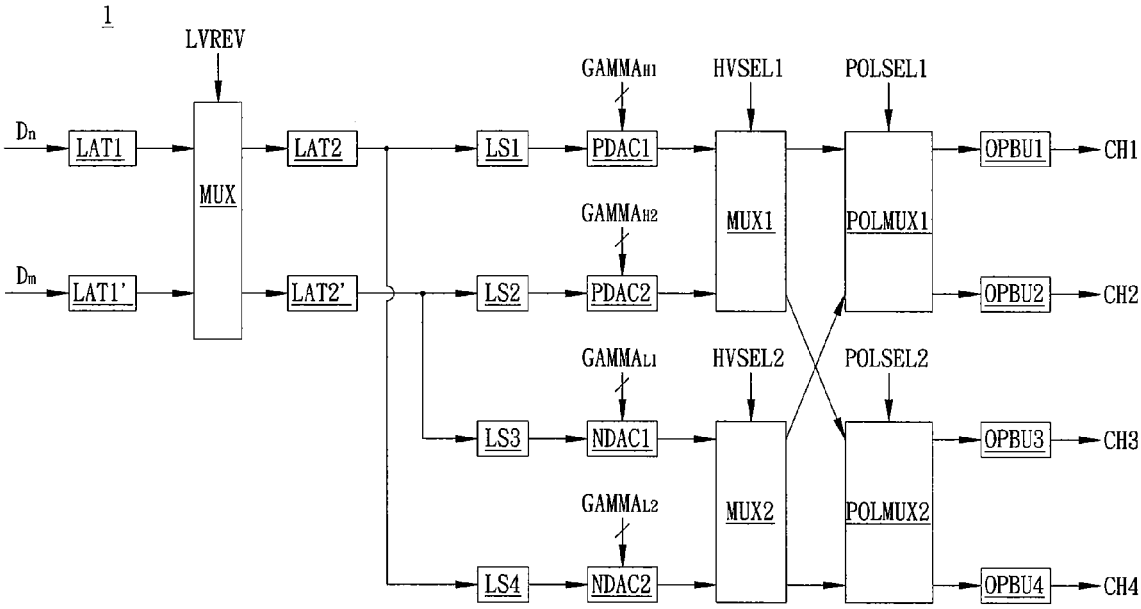
FIG. 2 illustrates a functional block diagram of the source driver of the first embodiment in the invention.

A first embodiment of the invention is a source driver. In this embodiment, the source driver is applied to the thin-film-transistor liquid crystal display (TFT-LCD), but not limited to this. It should be noticed that the source driver having four channels are taken as example, but the practical number of the channels can be 4N, wherein N is a positive integer. Please refer to FIG. 2. FIG. 2 illustrates a functional block diagram of the source driver of this embodiment.

As shown in FIG. 2, the source driver 1 includes two first latch modules LAT1 and LAT1', a low-voltage multiplexer MUX, two second latch modules LAT2 and LAT2', four level shifting modules LS1~LS4, two P-type digital/analog converting modules PDAC1 and PDAC2, two N-type digital/analog converting modules NDAC1 and NDAC2, two high-voltage multiplexers MUX1 and MUX2, two polarization multiplexers POLMUX1 and POLMUX2, four amplifying and buffer modules OPBU1~OPBU4, a first pair of channels CH1~CH2, and a second pair of channels CH3~CH4. Wherein, the first pair of channels CH1~CH2 includes a first channel CH1 and a second channel CH2 adjacent to the first channel CH1; the second pair of channels CH3~CH4 includes a third channel CH3 and a fourth channel CH4 adjacent to the third channel CH3. It should be noticed that the first pair of channels CH1~CH2 is adjacent to the second pair of channels CH3~CH4 or the first pair of channels CH1~CH2 is not adjacent to the second pair of channels CH3~CH4. There are no specific limitations.

In this embodiment, the low-voltage multiplexer MUX is a 2-to-2 multiplexer. Its two input terminals are coupled to two output terminals of the two first latch modules LAT1 and LAT1' respectively, and its two output terminals are coupled to two input terminals of the two second latch modules LAT2 and LAT2' respectively. The output terminal of the second latch module LAT2 is coupled to the input terminals of the level shifting modules LS1 and LS4 respectively; the output terminal of the second latch module LAT2' is coupled to the input terminals of the level shifting modules LS2 and LS3 respectively. The output terminal of the level shifting module LS1 is coupled to the P-type digital/analog converting module PDAC1; the output terminal of the level shifting module LS2 is coupled to the P-type digital/analog converting module PDAC2; the output terminal of the level shifting module LS3 is coupled to the N-type digital/analog converting module NDAC1; the output terminal of the level shifting module LS4 is coupled to the N-type digital/analog converting module NDAC2; the high-voltage multiplexer MUX1 is a 2-to-2 multiplexer. Its two input terminals are coupled to two output terminals of the P-type digital/analog converting modules PDAC1 and PDAC2. The high-voltage multiplexer MUX2 is a 2-to-2 multiplexer. Its two input terminals are coupled to two output terminals of the N-type digital/analog converting modules NDAC1 and NDAC2. The polarization multiplexer POLMUX1 is a 2-to-2 multiplexer. Its two input terminals are coupled to one output terminal of the high-voltage multiplexer MUX1 and one output terminal of the high-voltage multiplexer MUX2 respectively. The polarization multiplexer POLMUX2 is a 2-to-2 multiplexer. Its two input terminals are coupled to the other output terminal of the high-voltage multiplexer MUX1 and the other output terminal of the high-voltage multiplexer MUX2 respectively. The amplifying and buffer module OPBU1 is coupled between the polarization multiplexer POLMUX1 and the first channel CH1; the amplifying and buffer module OPBU2 is coupled between the polarization multiplexer POLMUX1 and the second channel CH2; the amplifying and buffer module OPBU3 is coupled between the polarization multiplexer POLMUX2 and the third channel CH3; the amplifying and buffer module OPBU4 is coupled between the polarization multiplexer POLMUX2 and the fourth channel CH4.

After the digital data signals Dn and Dm are inputted into the first latch modules LAT1 and LAT1' respectively, the low-voltage multiplexer MUX will couple to the first latch module LAT1 and the second latch module LAT2 and couple to the first latch module LAT1' and the second latch module LAT2' according to the control signal LVREV, so that the digital data signals Dn outputted by the first latch module LAT1 can be transmitted to the second latch module LAT2 and the digital data signals Dm outputted by the first latch module LAT1' can be transmitted to the second latch module LAT2', or the low-voltage multiplexer MUX will couple to the first latch module LAT1 and the second latch module LAT2' and couple to the first latch module LAT1' and the second latch module LAT2 according to the control signal LVREV, so that the digital data signal Dn outputted by the first latch module LAT1 can be transmitted to the second latch module LAT2' and the digital data signal Dm outputted by the first latch module LAT1' can be transmitted to the second latch module LAT2.

Then, the second latch module LAT2 will output the digital data signals Dn or Dm to the level shifting modules LS1 and LS4 respectively, and the second latch module LAT2' will output the digital data signals Dm or Dn to the level shifting modules LS2 and LS3 respectively. After the digital data signals Dm or Dn is processed by the level shifting modules LS1~LS4, a first digital data signal D1~a fourth digital data signal D4 will be outputted to the P-type digital/analog converting modules PDAC1~PDAC2 and the N-type digital/analog converting modules NDAC1~NDAC2 respectively, and the first digital data signal D1~the fourth digital data signal D4 will be converted into a first analog data signal A1~a fourth analog data signal A4 by the P-type digital/analog converting modules PDAC1-PDAC2 and the N-type digital/analog converting modules NDAC1-NDAC2 respectively.

It should be noticed that the P-type digital/analog converting modules PDAC1-PDAC2 and the N-type digital/analog converting modules NDAC1-NDAC2 correspond to two sets of different Gamma values respectively, wherein the P-type digital/analog converting module PDAC1 corresponds to $GAMMA_{H1}$; the P-type digital/analog converting module PDAC2 corresponds to $GAMMA_{H2}$; the N-type digital/analog converting module NDAC1 corresponds to $GAMMA_{L1}$; the N-type digital/analog converting module NDAC2 corresponds to $GAMMA_{L2}$.

Then, the first analog data signal A1 outputted by the P-type digital/analog converting module PDAC1 and the second analog data signal A2 outputted by the P-type digital/analog converting module PDAC2 will be transmitted to the high-voltage multiplexer MUX1. Similarly, the third analog data signal A3 outputted by the N-type digital/analog converting module NDAC1 and the fourth analog data signal A4 outputted by the N-type digital/analog converting module NDAC2 will be transmitted to the high-voltage multiplexer MUX2.

In this embodiment, the high-voltage multiplexers MUX1 and MUX2 are both 2-to-2 multiplexers. Wherein, the high-voltage multiplexer MUX1 can control its two input terminals to couple to the P-type digital/analog converting module PDAC1 and PDAC2 respectively according to the control signal HVSEL1 and control its two output terminals to couple to the polarization multiplexers POLMUX1 and POLMUX2, so that the high-voltage multiplexer MUX1 can output the first analog data signal A1 to the polarization multiplexer POLMUX1 and output the second analog data signal A2 to the polarization multiplexer POLMUX2, or the high-voltage multiplexer MUX1 can output the first analog data signal A1 to the polarization multiplexer POLMUX2 and output the second analog data signal A2 to the polarization multiplexer POLMUX1.

Similarly, the high-voltage multiplexer MUX2 can control its two input terminals to couple to the N-type digital/analog converting module NDAC1 and the N-type digital/analog converting module NDAC2 respectively according to the control signal HVSEL2 and control its two output terminals to couple to the polarization multiplexers POLMUX1 and POLMUX2 respectively, so that the high-voltage multiplexer MUX2 can output the third analog data signal A3 to the polarization multiplexer POLMUX1 and output the fourth analog data signal A4 to the polarization multiplexer POLMUX2, or the high-voltage multiplexer MUX2 can output the third analog data signal A3 to the polarization multiplexer POLMUX2 and output the fourth analog data signal A4 to the polarization multiplexer POLMUX1.

Then, the polarization multiplexer POLMUX1 can couple its first input terminal and first output terminal and couple its second input terminal and second output terminal according to the control signal POLSEL1, or the polarization multiplexer POLMUX1 can couple its first input terminal and second output terminal and couple its second input terminal and first output terminal according to the control signal POLSEL1, so that the first analog data signal A1, the second analog data signal A2, the third analog data signal A3, or the fourth analog data signal A4 can be selectively outputted to the amplifying and buffer module OPBU1 through the first output terminal of the polarization multiplexer POLMUX1 or outputted to the amplifying and buffer module OPBU2 through the second output terminal of the polarization multiplexer POLMUX1. Then, the first analog data signal A1, the second analog data signal A2, the third analog data signal A3, or the fourth analog data signal A4 will be processed by the amplifying and buffer modules OPBU1 or OPBU2 and outputted to the first channel CH1 and the second channel CH2.

Similarly, the polarization multiplexer POLMUX2 can couple its first input terminal and first output terminal and couple its second input terminal and second output terminal according to the control signal POLSEL2, or the polarization multiplexer POLMUX2 can couple its first input terminal and second output terminal and couple its second input terminal and first output terminal according to the control signal POLSEL2, so that the first analog data signal A1, the second analog data signal A2, the third analog data signal A3, or the fourth analog data signal A4 can be selectively outputted to the amplifying and buffer module OPBU3 through the first output terminal of the polarization multiplexer POLMUX2 or outputted to the amplifying and buffer module OPBU4 through the second output terminal of the polarization multiplexer POLMUX2. Then, the first analog data signal A1, the second analog data signal A2, the third analog data signal A3, or the fourth analog data signal A4 will be processed by the amplifying and buffer modules OPBU3 or OPBU4 and outputted to the first channel CH3 and the second channel CH4.

It should be noticed that because the control signals HVSEL1, HVSEL2, POLSEL1, and POLSEL2 are all digital control signals having two states of 1 and 0, there will be totally $2^4=16$ states for their combination. Please refer to Table 1. Table 1 shows under these 16 states, the analog data signals having different Gamma values (the first Gamma value H or the second Gamma value L) and polarities (+ or −) received by the first channel CH1~the fourth channel CH4 respectively.

TABLE 1

| HVSEL1 | HVSEL2 | POLSEL1 | POLSEL2 | CH1 | CH2 | CH3 | CH4 |
|---|---|---|---|---|---|---|---|
| 1 | 1 | 1 | 1 | H+ | L− | H+ | L− |
| 1 | 1 | 1 | 0 | H+ | L− | H− | L+ |
| 1 | 1 | 0 | 1 | H− | L+ | L+ | H− |
| 1 | 1 | 0 | 0 | H− | L+ | L− | H+ |
| 1 | 0 | 1 | 1 | H+ | L− | L+ | H− |
| 1 | 0 | 1 | 0 | H+ | L− | L− | H+ |
| 1 | 0 | 0 | 1 | H− | L+ | L+ | H− |
| 1 | 0 | 0 | 0 | H− | L+ | L− | H+ |
| 0 | 1 | 1 | 1 | L+ | H− | H+ | L− |
| 0 | 1 | 1 | 0 | L+ | H− | H− | L+ |
| 0 | 1 | 0 | 1 | L− | H+ | H+ | L− |
| 0 | 1 | 0 | 0 | L− | H+ | H− | L+ |
| 0 | 0 | 1 | 1 | L+ | H− | L+ | H− |
| 0 | 0 | 1 | 0 | L+ | H− | L− | H+ |
| 0 | 0 | 0 | 1 | L− | H+ | L+ | H− |
| 0 | 0 | 0 | 0 | L− | H+ | L− | H+ |

Figure 3:
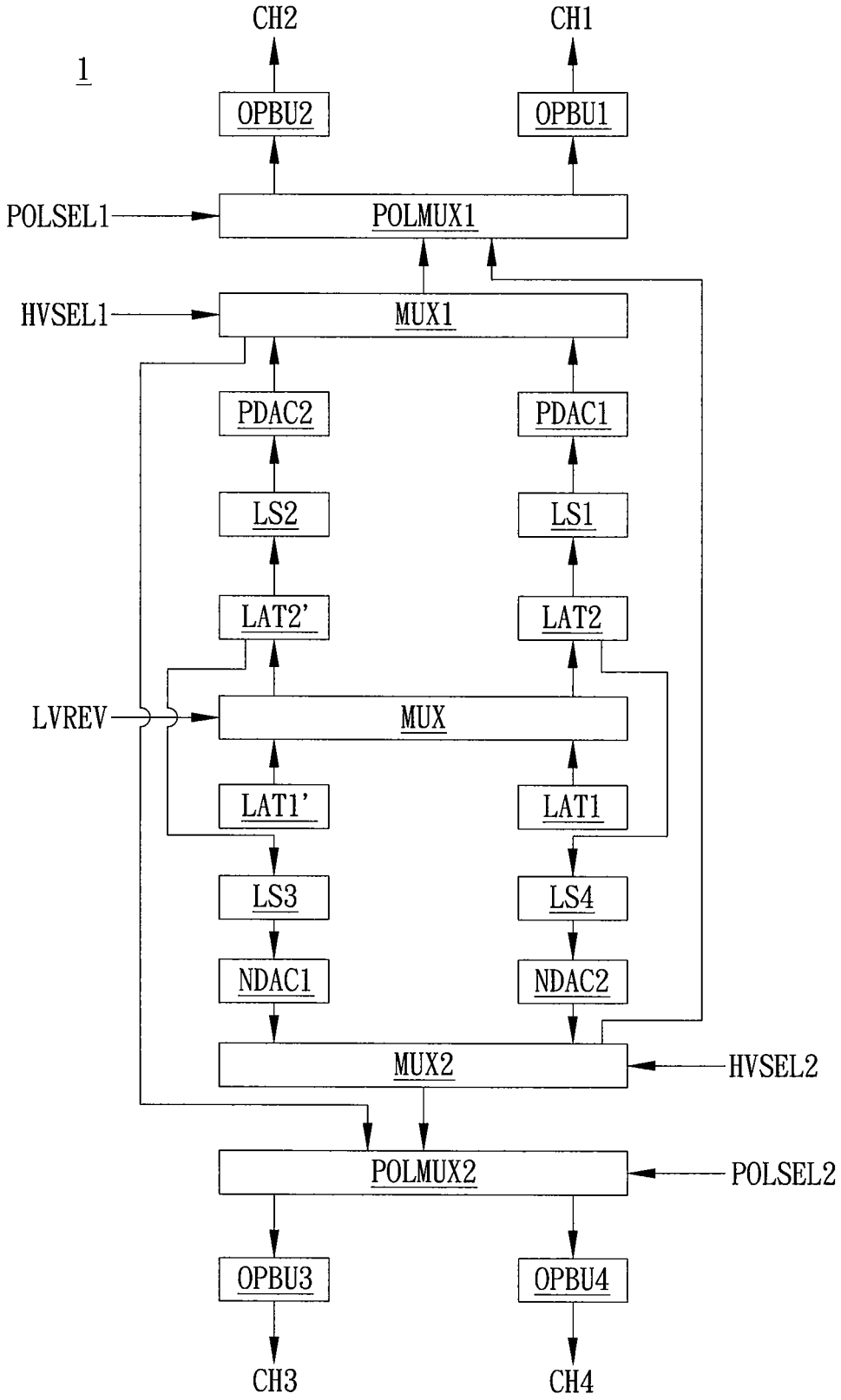
FIG. 3 illustrates a circuit layout floor plan of the source driver 1 of FIG. 2.

As shown in Table 1, for example, if the control signals HVSEL1, HVSEL2, POLSEL1, and POLSEL2 are equal to 1, the analog data signals received by the first channel CH1 and the third channel CH3 have the first Gamma value H and positive polarity +, and the analog data signals received by the second channel CH2 and the fourth channel CH4 have the second Gamma value L and negative polarity −. If the control signals HVSEL1, HVSEL2, and POLSEL1 are equal to 1 and POLSEL2 is equal to 0, the analog data signal received by the first channel CH1 has the first Gamma value H and positive polarity +, the analog data signal received by the second channel CH2 has the second Gamma value L and negative polarity −, the analog data signal received by the third channel CH3 has the first Gamma value H and negative polarity −, and the analog data signal received by the fourth channel CH4 has the second Gamma value L and positive polarity +, and so on. In addition, please also refer to FIG. 3. FIG. 3 illustrates a circuit layout floor plan of the source driver 1 of FIG. 2.

Figure 4:
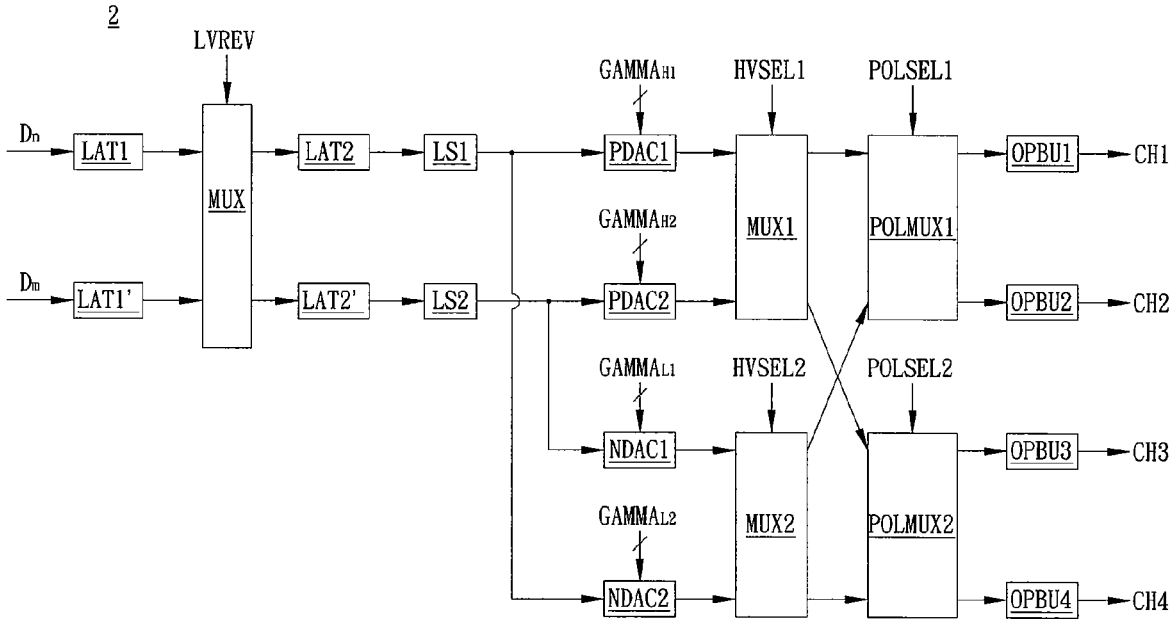
FIG. 4 illustrates a functional block diagram of the source driver of the second embodiment in the invention.

A second embodiment of the invention is also a source driver. In this embodiment, the source driver is applied to the thin-film-transistor liquid crystal display (TFT-LCD), but not limited to this. It should be noticed that the source driver having four channels are taken as example, but the practical number of the channels can be 4N, wherein N is a positive integer. Different from the first embodiment, in the second embodiment, a P-type digital/analog converting module and an N-type digital/analog converting module can share the same level shifting module to further save the chip usage area. Please refer to FIG. 4. FIG. 4 illustrates a functional block diagram of the source driver of this embodiment.

As shown in FIG. 4, the source driver 2 includes two first latch modules LAT1 and LAT1', a low-voltage multiplexer MUX, two second latch modules LAT2 and LAT2', two level shifting modules LS1~LS2, two P-type digital/analog converting modules PDAC1 and PDAC2, two N-type digital/analog converting modules NDAC1 and NDAC2, two high-voltage multiplexers MUX1 and MUX2, two polarization multiplexers POLMUX1 and POLMUX2, four amplifying and buffer modules OPBU1~OPBU4, a first pair of channels CH1~CH2, and a second pair of channels CH3~CH4. Wherein, the first pair of channels CH1~CH2 includes a first channel CH1 and a second channel CH2 adjacent to the first channel CH1; the second pair of channels CH3~CH4 includes a third channel CH3 and a fourth channel CH4 adjacent to the third channel CH3. It should be noticed that the first pair of channels CH1~CH2 can be adjacent to the second pair of channels CH3~CH4 or not without any limitations.

In this embodiment, the low-voltage multiplexer MUX is a 2-to-2 multiplexer. Its two input terminals are coupled to two output terminals of the two first latch modules LAT1 and LAT1' respectively, and its two output terminals are coupled to two input terminals of the two second latch modules LAT2 and LAT2'respectively. The output terminal of the second latch module LAT2 is coupled to the input terminal of the level shifting module LS1; the output terminal of the second latch module LAT2' is coupled to the input terminal of the level shifting module LS2. The output terminal of the level shifting module LS1 is coupled to the P-type digital/analog converting module PDAC1 and the N-type digital/analog converting module NDAC2 respectively; the output terminal of the level shifting module LS2 is coupled to the P-type digital/analog converting module PDAC2 and the N-type digital/analog converting module NDAC1 respectively. The high-voltage multiplexer MUX1 is a 2-to-2 multiplexer. Its two input terminals are coupled to two output terminals of the P-type digital/analog converting modules PDAC1 and PDAC2. The high-voltage multiplexer MUX2 is a 2-to-2 multiplexer. Its two input terminals are coupled to two output terminals of the N-type digital/analog converting modules NDAC1 and NDAC2. The polarization multiplexer POLMUX1 is a 2-to-2 multiplexer. Its two input terminals are coupled to one output terminal of the high-voltage multiplexer MUX1 and one output terminal of the high-voltage multiplexer MUX2 respectively. The polarization multiplexer POLMUX2 is a 2-to-2 multiplexer. Its two input terminals are coupled to the other output terminal of the high-voltage multiplexer MUX1 and the other output terminal of the high-voltage multiplexer MUX2 respectively. The amplifying and buffer module OPBU1 is coupled between the polarization multiplexer POLMUX1 and the first channel CH1; the amplifying and buffer module OPBU2 is coupled between the polarization multiplexer POLMUX1 and the second channel CH2; the amplifying and buffer module OPBU3 is coupled between the polarization multiplexer POLMUX2 and the third channel CH3; the amplifying and buffer module OPBU4 is coupled between the polarization multiplexer POLMUX2 and the fourth channel CH4.

After the digital data signals Dn and Dm are inputted into the first latch modules LAT1 and LAT1' respectively, the low-voltage multiplexer MUX will couple to the first latch module LAT1 and the second latch module LAT2 and couple to the first latch module LAT1' and the second latch module LAT2' according to the control signal LVREV, so that the digital data signals Dn outputted by the first latch module LAT1 can be transmitted to the second latch module LAT2 and the digital data signals Dm outputted by the first latch module LAT1' can be transmitted to the second latch module LAT2', or the low-voltage multiplexer MUX will couple to the first latch module LAT1 and the second latch module LAT2' and couple to the first latch module LAT1' and the second latch module LAT2 according to the control signal LVREV, so that the digital data signal Dn outputted by the first latch module LAT1 can be transmitted to the second latch module LAT2' and the digital data signal Dm outputted by the first latch module LAT1' can be transmitted to the second latch module LAT2.

Then, the second latch module LAT2 will output the digital data signals Dn or Dm to the level shifting module LS1, and the second latch module LAT2' will output the digital data signals Dm or Dn to the level shifting module LS2. After the digital data signals Dm or Dn is processed by the level shifting modules LS1~LS2, a first digital data signal D1~a fourth digital data signal D4 will be outputted to the P-type digital/analog converting modules PDAC1~PDAC2 and the N-type digital/analog converting modules NDAC1~NDAC2 respectively, and the first digital data signal D1~the fourth digital data signal D4 will be converted into a first analog data signal A1~a fourth analog data signal A4 by the P-type digital/analog converting modules PDAC1~PDAC2 and the N-type digital/analog converting modules NDAC1~NDAC2 respectively.

It should be noticed that the P-type digital/analog converting modules PDAC1~PDAC2 and the N-type digital/analog converting modules NDAC1~NDAC2 correspond to two sets of different Gamma values respectively, wherein the P-type digital/analog converting module PDAC1 corresponds to $GAMMA_{H1}$; the P-type digital/analog converting module PDAC2 corresponds to $GAMMA_{H2}$; the N-type digital/analog converting module NDAC1 corresponds to $GAMMA_{L1}$; the N-type digital/analog converting module NDAC2 corresponds to $GAMMA_{L2}$.

Then, the first analog data signal A1 outputted by the P-type digital/analog converting module PDAC1 and the second analog data signal A2 outputted by the P-type digital/analog converting module PDAC2 will be transmitted to the high-voltage multiplexer MUX1. Similarly, the third analog data signal A3 outputted by the N-type digital/analog converting module NDAC1 and the fourth analog data signal A4 outputted by the N-type digital/analog converting module NDAC2 will be transmitted to the high-voltage multiplexer MUX2.

In this embodiment, the high-voltage multiplexers MUX1 and MUX2 are both 2-to-2 multiplexers. Wherein, the high-voltage multiplexer MUX1 can control its two input terminals to couple to the P-type digital/analog converting module PDAC1 and PDAC2 respectively according to the control signal HVSEL1 and control its two output terminals to couple to the polarization multiplexers POLMUX1 and POLMUX2, so that the high-voltage multiplexer MUX1 can output the first analog data signal A1 to the polarization multiplexer POLMUX1 and output the second analog data signal A2 to the polarization multiplexer POLMUX2, or the high-voltage multiplexer MUX1 can output the first analog data signal A1 to the polarization multiplexer POLMUX2 and output the second analog data signal A2 to the polarization multiplexer POLMUX1.

Similarly, the high-voltage multiplexer MUX2 can also control its two input terminals to couple to the N-type digital/analog converting module NDAC1 and NDAC2 respectively according to the control signal HVSEL2 and control its two output terminals to couple to the polarization multiplexers POLMUX1 and POLMUX2 respectively, so that the high-voltage multiplexer MUX2 can output the third analog data signal A3 to the polarization multiplexer POLMUX1 and output the fourth analog data signal A4 to the polarization multiplexer POLMUX2, or the high-voltage multiplexer MUX2 can output the third analog data signal A3 to the polarization multiplexer POLMUX2 and output the fourth analog data signal A4 to the polarization multiplexer POLMUX1.

Then, the polarization multiplexer POLMUX1 can couple its first input terminal and first output terminal and couple its second input terminal and second output terminal according to the control signal POLSEL1, or the polarization multiplexer POLMUX1 can couple its first input terminal and second output terminal and couple its second input terminal and first output terminal according to the control signal POLSEL1, so that the first analog data signal A1, the second analog data signal A2, the third analog data signal A3, or the fourth analog data signal A4 can be selectively outputted to the amplifying and buffer module OPBU1 through the first output terminal of the polarization multiplexer POLMUX1 or outputted to the amplifying and buffer module OPBU2 through the second output terminal of the polarization multiplexer POLMUX1. Then, the first analog data signal A1, the second analog data signal A2, the third analog data signal A3, or the fourth analog data signal A4 will be processed by the amplifying and buffer modules OPBU1 or OPBU2 and outputted to the first channel CH1 and the second channel CH2.

Similarly, the polarization multiplexer POLMUX2 can also couple its first input terminal and first output terminal and couple its second input terminal and second output terminal according to the control signal POLSEL2, or the polarization multiplexer POLMUX2 can couple its first input terminal and second output terminal and couple its second input terminal and first output terminal according to the control signal POLSEL2, so that the first analog data signal A1, the second analog data signal A2, the third analog data signal A3, or the fourth analog data signal A4 can be selectively outputted to the amplifying and buffer module OPBU3 through the first output terminal of the polarization multiplexer POLMUX2 or outputted to the amplifying and buffer module OPBU4 through the second output terminal of the polarization multiplexer POLMUX2. Then, the first analog data signal A1, the second analog data signal A2, the third analog data signal A3, or the fourth analog data signal A4 will be processed by the amplifying and buffer modules OPBU3 or OPBU4 and outputted to the first channel CH3 and the second channel CH4.

Figure 5:
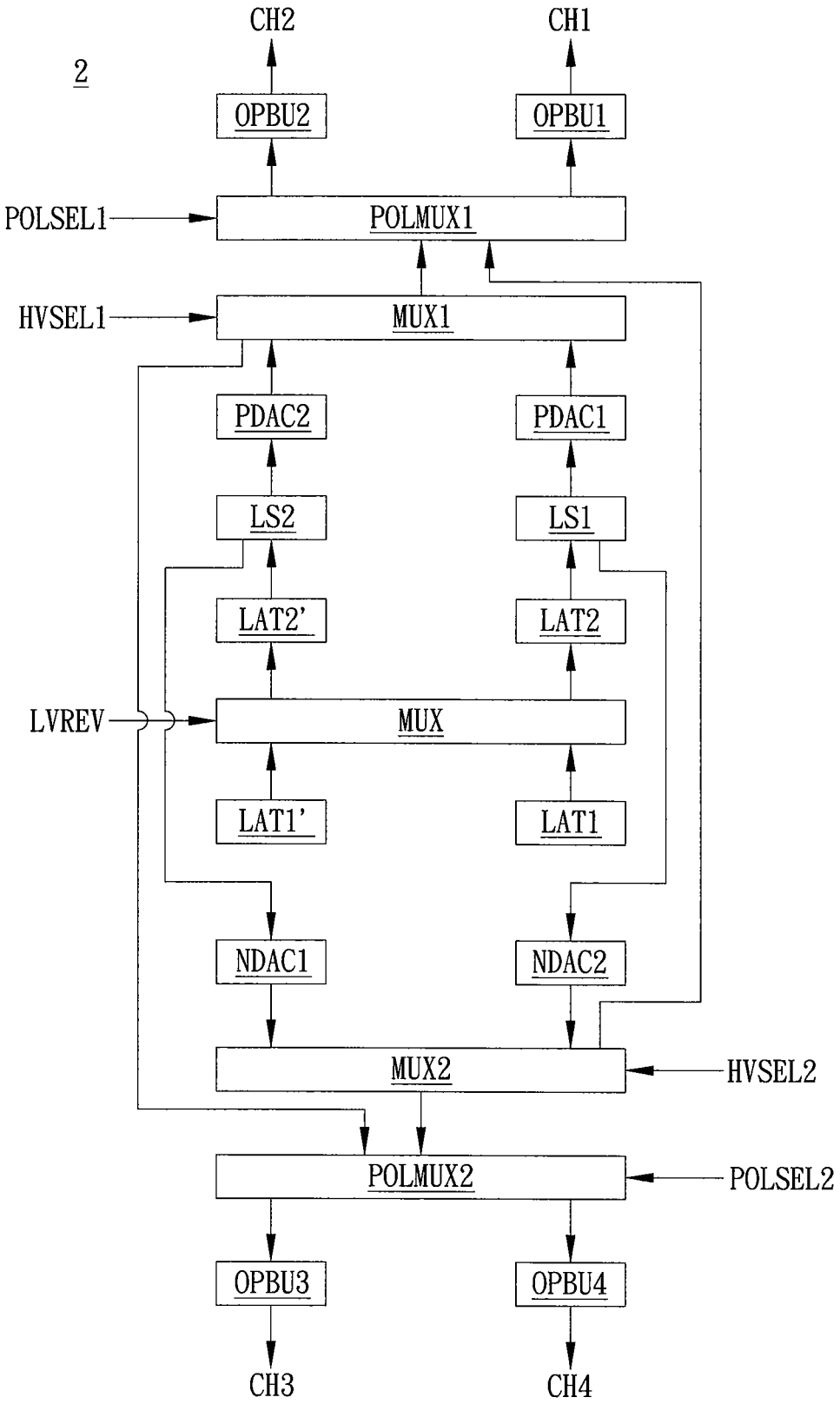
FIG. 5 illustrates a circuit layout floor plan of the source driver 2 of FIG. 4.

It should be noticed that because the control signals HVSEL1, HVSEL2, POLSEL1, and POLSEL2 are all digital control signals having two states of 1 and 0, there will be totally $2^4=16$ states for their combination. Please refer to Table 1. Table 1 shows under these 16 states, the analog data signals having different Gamma values (the first Gamma value H or the second Gamma value L) and polarities (+ or −) received by the first channel CH1~the fourth channel CH4 respectively. In addition, please also refer to FIG. 5. FIG. 5 illustrates a circuit layout floor plan of the source driver 2 of FIG. 4. After comparing FIG. 5 with FIG. 3, it can be found that a P-type digital/analog converting module and an N-type digital/analog converting module of the source driver 2 shown in FIG. 5 can share the same level shifting module; therefore, the source driver 2 of FIG. 5 can save more chip usage area than the source driver 1 of FIG. 3.

Compared to the prior art, the source driver having two sets of Gamma values according to the invention only needs four digital/analog converting modules correspondingly disposed for its two pairs of channels; that is to say, the four digital/analog converting modules can be shared by the two pairs of channels. Therefore, the number of the digital/analog converting modules the source driver of the invention needs can be reduced to the half of the prior arts, and the chip usage area can be largely saved to further reduce the volume of the chip.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

The invention claimed is:

1. A source driver, applied to a liquid crystal display, the source driver comprising:

a first pair of channels, comprising a first channel and a second channel adjacent to the first channel;

a second pair of channels, comprising a third channel and a fourth channel adjacent to the third channel;

a first P-type digital/analog converting module, for converting a first digital data signal into a first analog data signal;

a second P-type digital/analog converting module, for converting a second digital data signal into a second analog data signal;

a first N-type digital/analog converting module, for converting a third digital data signal into a third analog data signal;

a second N-type digital/analog converting module, for converting a fourth digital data signal into a fourth analog data signal;

a first multiplexer, coupled to the first P-type digital/analog converting module and the second P-type digital/analog converting module respectively, for receiving the first analog data signal and the second analog data signal from the first P-type digital/analog converting module and the second P-type digital/analog converting module respectively;

a second multiplexer, coupled to the first N-type digital/analog converting module and the second N-type digital/analog converting module respectively, for receiving the third analog data signal and the fourth analog data signal from the first N-type digital/analog converting module and the second N-type digital/analog converting module respectively;

a first polarization multiplexer, coupled to the first multiplexer and the second multiplexer, for receiving the first analog data signal or the second analog data signal from the first multiplexer and receiving the third analog data signal or the fourth analog data signal from the second multiplexer;

a second polarization multiplexer, coupled to the first multiplexer and the second multiplexer, for receiving the first analog data signal or the second analog data signal from the first multiplexer and receiving the third analog data signal or the fourth analog data signal from the second multiplexer;

a first amplifying and buffer module, coupled between the first polarization multiplexer and the first channel of the first pair of channels, for outputting the first analog data signal, the second analog data signal, the third analog data signal, or the fourth analog data signal to the first channel;

a second amplifying and buffer module, coupled between the first polarization multiplexer and the second channel of the first pair of channels, for outputting the first analog data signal, the second analog data signal, the third analog data signal, or the fourth analog data signal to the second channel;

a third amplifying and buffer module, coupled between the second polarization multiplexer and the third channel of the second pair of channels, for outputting the first analog data signal, the second analog data signal, the third analog data signal, or the fourth analog data signal to the third channel; and a fourth amplifying and buffer module, coupled between the second polarization multiplexer and the fourth channel of the second pair of channels, for outputting the first analog data signal, the second analog data signal, the third analog data signal, or the fourth analog data signal to the fourth channel.

2. The source driver of claim 1, further comprising two first latch modules, a low-voltage multiplexer, and two second latch modules, the low-voltage multiplexer is coupled between the two first latch modules and the two second latch modules.

3. The source driver of claim 2, further comprising a first level shifting module, a second level shifting module, a third level shifting module, and a fourth level shifting module, the first level shifting module, the second level shifting module, the third level shifting module, and the fourth level shifting module are coupled to the first P-type digital/analog converting module, the second P-type digital/analog converting module, the first N-type digital/analog converting module, and the second N-type digital/analog converting module respectively.

4. The source driver of claim 3, wherein the first level shifting module and the fourth level shifting module are coupled to one of the two second latch modules, and the second level shifting module and the third level shifting module are coupled to the other of the two second latch modules.

5. The source driver of claim 2, further comprising a first level shifting module and a second level shifting module, the first level shifting module is coupled to the first P-type digital/analog converting module and the second N-type digital/analog converting module respectively, and the second level shifting module is coupled to the second P-type digital/analog converting module and the first N-type digital/analog converting module respectively.

6. The source driver of claim 5, wherein the first level shifting module and the second level shifting module are coupled to the two latch modules respectively.

7. The source driver of claim 1, wherein the first pair of channels is adjacent to the second pair of channels or the first pair of channels is not adjacent to the second pair of channels.

8. The source driver of claim 1, wherein the first P-type digital/analog converting module and the second P-type digital/analog converting module correspond to a first set of gamma values, and the first N-type digital/analog converting module and the second N-type digital/analog converting module correspond to a second set of gamma values, accordingly the first analog data signal and the second analog data signal have the first set of gamma values and the third analog data signal and the fourth analog data signal have the second set of gamma values.

9. The source driver of claim 1, wherein the first polarization multiplexer controls two of the first analog data signal, the second analog data signal, the third analog data signal, and the fourth analog data signal to have positive polarity and negative polarity respectively according to a control signal; the second polarization multiplexer controls the others of the first analog data signal, the second analog data signal, the third analog data signal, and the fourth analog data signal to have positive polarity and negative polarity respectively according to the control signal.

10. The source driver of claim 1, wherein the first P-type digital/analog converting module and the second P-type digital/analog converting module correspond to the first pair of channels and the first N-type digital/analog converting module and the second N-type digital/analog converting module correspond to the second pair of channels.

* * * * *